United States Patent [19]

Vezina

[11] 4,252,317

[45] Feb. 24, 1981

[54] PUTTER

[76] Inventor: Clement Vezina, 1124, Chemin Royal, St-Pierre, Ile d'Orleans, Quebec, Canada, G0A 4E0

[21] Appl. No.: 15,662

[22] Filed: Feb. 27, 1979

[51] Int. Cl. ..... A63B 53/16

[52] U.S. Cl. ..... 273/81.2; 273/79; 273/81.3; 273/171

[58] Field of Search ..... 273/77 R, 79, 80.1, 273/81 R, 81 C, 81 D, 81.2, 81.3, 167 R, 167 G, 168, 171, 193 B, 193 R, 80 R, 80 C, 80 D, 80.2, 194 R, 192, 75, 81.4

[56] References Cited

U.S. PATENT DOCUMENTS

| | | | |
|---|---|---|---|
| 14,823 | 3/1856 | Allen | 273/168 X |
| 749,174 | 1/1904 | Davis | 273/79 |
| 1,352,020 | 9/1920 | Olson | 273/79 |
| 1,657,972 | 1/1928 | Rowe | 273/79 |
| 2,155,830 | 4/1939 | Howard | 273/80 C X |
| 2,321,773 | 6/1943 | Ruemelin | 273/81.3 X |
| 2,325,525 | 7/1943 | Lukenbill | 273/81.3 |
| 2,336,405 | 12/1943 | Kent | 273/79 |
| 2,445,718 | 7/1948 | Sternberg et al. | 273/81.3 |
| 2,708,579 | 5/1955 | Hugman | 273/80.1 X |
| 4,174,108 | 11/1979 | Reinholz | 273/79 |

FOREIGN PATENT DOCUMENTS

| | | | |
|---|---|---|---|
| 20007 | 11/1934 | Australia | 273/83 |
| 13480 | of 1907 | United Kingdom | 273/83 |
| 1118181 | 6/1968 | United Kingdom | 273/80.1 |
| 1232651 | 5/1971 | United Kingdom | 273/171 |

*Primary Examiner*—Richard J. Apley
*Attorney, Agent, or Firm*—Swabey, Mitchell, Houle, Marcoux & Sher

[57] ABSTRACT

Disclosed is a putter which is made of a lower shaft and an upper shaft, both shafts being rotatable with respect to one another and enabling to convert a right handed putter into a left handed putter and vice versa. Furthermore, the handle is arranged so as to create a pendulum effect thus enabling the putter head to hit the ball and causing it to travel along a very straight line.

9 Claims, 3 Drawing Figures

PUTTER

BACKGROUND OF THE INVENTION (a) Field of the Invention

This invention relates to a putter. More particularly, the invention is directed to a golf putter especially aimed at improving the putting game of an amateur or week-end golfer.

(b) Description of Prior Art

It is well known that putting is probably the most difficult and frustrating part of the game of golf. It all stems out from the fact that if the ball is not hit right and with the proper strength, it will either not reach the hole or miss it completely.

Attempts have been made to produce golf putters destined to give a pendulum motion for hitting the ball. A putter of this kind has been described in U.S. Pat. No. 3,170,690. Other patents of interest are U.S. Pat. Nos. 2,321,773 and 2,445,718.

However, to our knowledge, no putter is presently available which simulates a pendulum motion while being convertible for either right handed or left handed players.

SUMMARY OF THE INVENTION

It is an object of the present invention to provide a golf putter which may be used either by a left handed or a right handed player.

It is another object of the invention to provide a putter in which the handle is adjustable in height.

It is another object of the present invention to provide a putter which can be used by giving it a pendulum motion.

Broadly the golf putter according to the invention comprises a lower shaft, a putter head fixedly mounted at the lower end of the lower shaft, an upper shaft rotatably mounted at the upper end of the lower shaft and a handle which appears at the upper end of the upper shaft. The golf putter should be so constructed and arranged that by effecting a 180° rotation of the upper shaft with respect to the lower shaft, a right handed putter can be converted into a left handed putter and vice versa.

DESCRIPTION OF PREFERRED EMBODIMENTS

Figure 1:
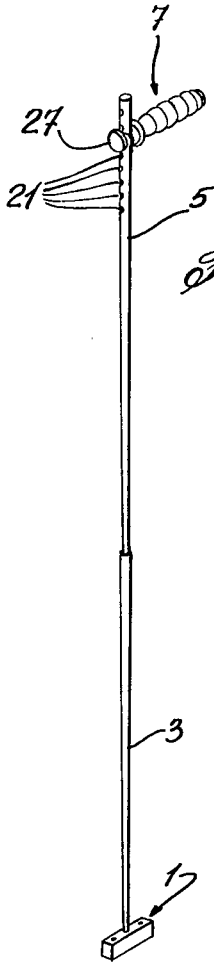
FIG. 1 is a perspective view of a putter according to the invention.

Referring to the drawings, it will be seen that the putter essentially comprises four parts, namely a putter head 1, a lower shaft 3, an upper shaft 5, and a handle 7.

Figure 2:
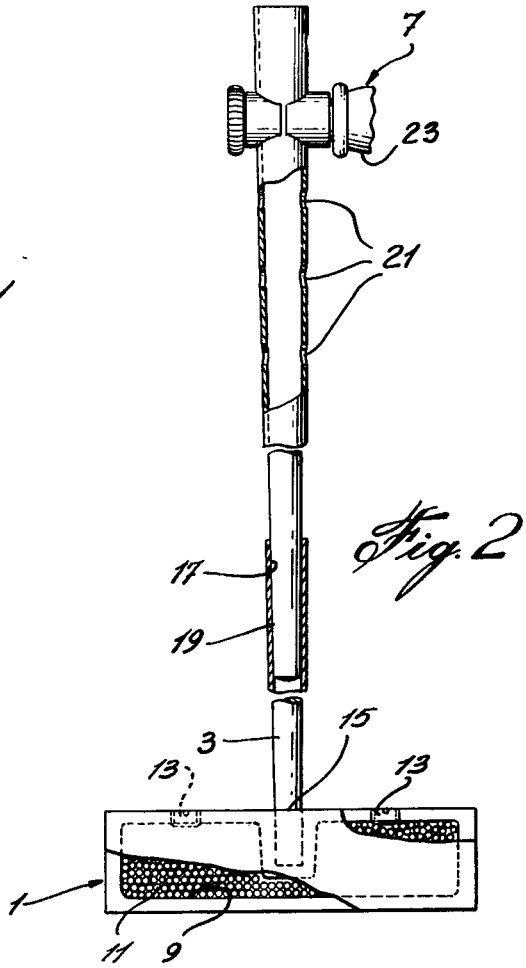
FIG. 2 is a view showing the putting partly in longitudinal cross-section.

Although the putter head 1 may adopt a wide variety of shapes, it has been illustrated as having a box-like configuration. As shown in dotted line, in FIG. 2, the putter head has been partially hollowed out to form a cavity 9 which is adapted to receive a certain number of weights 11 depending on the ultimate weight of the putter head which the golfer might wish to choose for his game.

In order to insert the weights 11 inside the cavity 9 of the putter head 9, there are provided on the upper face of the putter head, a pair of openings which are closed by means of screws 13.

As mentioned above, the putter has a lower shaft 3. The latter is fixed by any known means to the putter head 1, at 15 such as by screwing, soldering, etc. The lower shaft 3 is slightly conical in shape and has a conical recess 17 at the upper end thereof. The purpose of this recess will be given below when describing the upper shaft 5.

The upper shaft 5 is also slightly conical in order that its lower end 19 be rotatably engaged in the conical recess 17 mentioned above and which appears at the upper end of the lower shaft 3. Of course, any other means to connect the lower end of the upper shaft 5 with the upper end of the lower shaft 3 would be suitable provided that the two shafts be rotatable with respect to one another.

Returning again to the upper shaft 5, the latter will be seen to also comprise a number of transverse holes 21 which are formed and aligned one over the other at different levels along the upper shaft 5. These holes 21 each extend all through the upper shaft 5.

Turning now to the handle 7, as shown it will be seen that it consists of a handle proper 23 and an arm 25 which projects outside the handle proper 23 at the outer end thereof.

Figure 3:
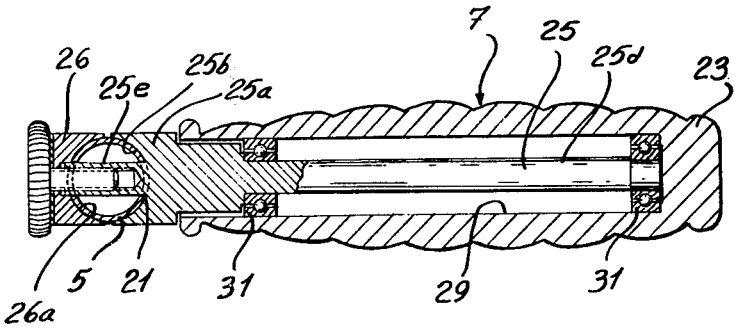
FIG. 3 is a cross-section through the handle.

The portion of the arm 25 which projects outside the handle proper 23 has an enlarged portion **25*a* which is concave at 25*b* to engage with the upper shaft 7. A tubular part 25*c* which is formed at the end of enlarged portion 25*a* is inserted and extends all through a selected hole 21 depending on a particular height selected by the golf player on the upper shaft 5 for mounting the handle 7. A sleeve 26 having a concave end 26*a* is placed over the end of tubular threaded part 25*c* and screw 27 is screwed into tubular threaded part 25*c* all in the manner as shown in FIG. 3 of the drawings. In this manner, the putter is suitable for any golf player who merely has to select a particular hole 21 for mounting the handle 7**.

It should be pointed out that one of the aims of this putter is to enable it to be used with a pendulum motion. For this purpose, the handle proper 23 is formed with a bore 29 which extends axially inside the handle proper 23. Furthermore, two ball bearings 31 are disposed inside the bore, so that after the inner portion **25*d* of the arm 25 has been inserted into the bore 29, the arm 25 will be capable of rolling on the ball bearings 31 relative to the handle proper 23. Finally, in order to hold the inner portion 25*d* of the arm 25 inside the bore 29, the inner portion 25*d* can be press fitted inside bore 29 or else a screw (not shown) could be screwed at the end of inner portion 25*d***. Other means could of course be used.

This arrangement will first of all enable to convert a right handed putter into a left handed putter by a mere 180° rotation of the upper shaft 5 relative to the lower shaft 3. Vice versa, if the putter is left handed, it will be converted into a right handed putter by another 180° rotation of the upper shaft 5 relative to the lower shaft 3.

Finally, in view of the possibility of rolling the handle 7, it will be seen that the putter can easily be given a pendulum motion thus making sure that a golf ball hit with the putter head will really adopt a straight line.

I claim:

1. A golf putter comprising:

a lower shaft formed with a conical recess at the upper end thereof;

a putter head fixedly mounted at the lower end of said lower shaft;

an upper shaft mounted at the upper end of said lower shaft, the lower end of said upper shaft being tapered to be rotatably engaged in said conical recess;

a handle at the upper end of said upper shaft;

so constructed and arranged that by effecting a 180° rotation of said upper shaft relative to said lower shaft a right handed putter is converted into a left handed putter and vice versa.

2. A golf putter according to claim 1, wherein said putter head is at least partially hollowed out to receive weights.

3. A golf putter according to claim 2, which comprises openings formed in said putter to insert said weights inside said putter head.

4. A golf putter according to claim 3, which comprises screws to close said openings.

5. A golf putter according to claim 4, wherein said putter head has box-like configuration.

6. A golf putter according to claim 1, wherein said handle is transversely mounted at the upper end of said upper shaft and means are provided to adjust the height at which said handle is mounted on said upper shaft.

7. A golf putter according to claim 6, which comprises a plurality of holes transversely extending through said upper shaft, said holes being formed one over the other at different levels along said upper shaft, said handle being provided with an arm, said arm being inserted into one of said holes depending on the selected height of the handle, the outer end of said arm extending beyond said hole and a screw mounted at the outer end of said arm to fix said handle at said selected height on said upper shaft.

8. A golf putter according to claim 7, wherein said handle is formed with a bore, a ball bearing being disposed in said bore, the inner portion of said arm being mounted inside said handle to roll on said ball bearing relative the said handle, and means to retain the inner portion of said arm inside said handle.

9. A golf putter comprising a lower shaft which is formed with a conical recess at the upper end thereof, a putter head having box-like configuration fixedly mounted at the lower end of said lower shaft, said putter head being at least partially hollowed out to receive weights and comprising openings to insert said weight inside said putter head and screws to close said openings, an upper shaft, the lower end thereof being tapered to be rotatably engaged in said conical recess at the upper end of said lower shaft, said upper shaft comprising a plurality of holes transversely extending through said upper shaft, said holes being formed and aligned one over the other at different levels along said upper shaft, a handle provided with an arm, said arm being inserted into one of said holes depending on a height selected on said upper shaft for said handle, the outer end of said arm extending beyond said hole and a screw mounted at the outer end of said arm to transversely fix said handle at said selected height on said upper shaft, said handle being formed with a bore, a ball bearing being disposed in said bore, the inner portion of said arm being mounted inside said handle to roll on said ball bearing relative to said handle and means to retain the inner portion of said arm inside said handle, so constructed and arranged that by effecting a 180° rotation of said upper shaft relative to said lower shaft a right handed putter is converted into a left handed putter and vice versa.

* * * * *